US008858014B2

(12) United States Patent
Perquy et al.

(10) Patent No.: US 8,858,014 B2
(45) Date of Patent: Oct. 14, 2014

(54) SLAT PROFILE FOR HOLDING AN LED STRIP AND SLAT WALL COMPRISING SUCH A SLAT PROFILE

(75) Inventors: Patrick Marc Perquy, Drongen (BE); Lieven Andre Eric Depraetere, Bellegem (BE)

(73) Assignees: Renson Sunprotection Projects NV, Waregem (BE); Paul Renson, Waregem (BE)

( * ) Notice: Subject to any disclaimer, the term of this patent is extended or adjusted under 35 U.S.C. 154(b) by 73 days.

(21) Appl. No.: 13/821,114

(22) PCT Filed: Sep. 7, 2011

(86) PCT No.: PCT/IB2011/002080

§ 371 (c)(1),
(2), (4) Date: Mar. 6, 2013

(87) PCT Pub. No.: WO2012/032396

PCT Pub. Date: Mar. 15, 2012

(65) Prior Publication Data

US 2013/0170191 A1 Jul. 4, 2013

(30) Foreign Application Priority Data

Sep. 7, 2010 (BE) ..... 2010/0532

(51) Int. Cl.

| | |
|---|---|
| ***F21V 33/00*** | (2006.01) |
| ***F21S 4/00*** | (2006.01) |
| ***E04F 10/08*** | (2006.01) |
| ***E06B 7/086*** | (2006.01) |
| ***F21V 15/01*** | (2006.01) |

(52) U.S. Cl.

CPC ..... *F21V 33/006* (2013.01); *F21S 4/008* (2013.01); *E04F 10/08* (2013.01); *E06B 7/086* (2013.01); *F21V 15/013* (2013.01)

USPC ..... 362/147

(58) Field of Classification Search

CPC ..... F21V 33/006; F21V 15/013; F21V 17/06; F21V 17/10; F21V 19/00; F21V 19/003; F21V 19/0035; F21V 21/00; F21V 21/02; F21S 4/00; F21S 4/001; F21S 4/003; F21S 4/008; E06B 7/086; E04F 10/08

See application file for complete search history.

(56) References Cited

U.S. PATENT DOCUMENTS

| | | | | |
|---|---|---|---|---|
| 5,810,468 | A * | 9/1998 | Shimada | 362/146 |
| 6,416,200 | B1 * | 7/2002 | George | 362/146 |
| 6,793,369 | B2 * | 9/2004 | Calzaretta et al. | 362/219 |

FOREIGN PATENT DOCUMENTS

| | | | |
|---|---|---|---|
| CN | 201222332 | Y | 4/2009 |
| EP | 2177705 | A2 | 4/2010 |
| FR | 2076213 | A5 | 10/1971 |
| NL | 1033785 | C1 | 11/2008 |

OTHER PUBLICATIONS

International Search Report dated Jul. 24, 2012.

* cited by examiner

*Primary Examiner* — Bao Q Truong

(74) *Attorney, Agent, or Firm* — Symbus Law Group, LLC; Clifford D. Hyra

(57) ABSTRACT

The present invention relates to a slat profile (1) for holding an LED strip (8), in which said LED strip (8) can be readily replaced and the slat profile (1) can be of a longer design than existing slat profiles (1) of this type, comprising a supporting profile (2) which can be attached to a supporting structure (17) of a slat wall (20) in order to accommodate the slat profile (1) in the slat wall (20), a closing profile (3) which, in the installed position of the slat profile (1), can be moved with respect to the supporting profile (2) between an open position in which the LED strip (8) can be fitted in the slat profile (1) and a closed position. The present invention also relates to a slat wall (20) which comprises such a slat profile (1).

14 Claims, 2 Drawing Sheets

SLAT PROFILE FOR HOLDING AN LED STRIP AND SLAT WALL COMPRISING SUCH A SLAT PROFILE

This application claims the benefit of Belgian patent application No. 2010/0532, filed Sep. 7, 2010, which is hereby incorporated by reference in its entirety.

BACKGROUND

An LED strip is a strip of LED lights which may be of flexible or rigid design. The term LED light is understood to mean a light-emitting diode which is encapsulated in a transparent housing, as is, for example, the case with the existing embodiments of most commercially available LEDs.

Slat walls are currently usually used as sunshade and/or outside wall cladding. Using slat profiles for holding an LED strip, slat walls can be constructed which also serve as lighting and/or as traffic signs.

Such a slat system, which can also serve as lighting and/or as a traffic sign, is for example described in NL 1 033 785 C. However, the drawback of this system is that the slats have to be completely removed in order to be able to replace any faulty LEDs, as the closing caps at the ends of the slats have to be opened and the LEDs have to be replaced via these ends. In order to be able to carry this out in practice, such a slat system can only have limited dimensions. Such a slat system is therefore also less suitable for use as cladding, for example, of a façade section covering a relatively large surface.

CN 201222332 Y also describes a slat system which can serve as lighting and/or as a traffic sign. In this case, the slats comprise a cavity in which an LED strip can be fitted and a slot which allows access to this cavity and which is covered by this LED strip after the latter has been fitted. However, in this case, the slats also have to be removed in order to be able to replace the LED strip. Therefore, this slat system is also less suitable for use as cladding, for example, of a façade section covering a relatively large surface.

In order to house LED strips in slat walls, it might be considered to house these in slat profiles which comprise a supporting profile and a closing profile according to the preamble of the first claim, such as for example the slat profiles which are described in EP 2 177 705 A2 or in FR 2 076 213 A5. However, these slat profiles still require separate fastening elements in order to fit the LED strips in the cavities via the slots. Such fastening elements render mounting and dismantling of the LED strips more complex again. Without additional fastening elements, however, the LED strips have to be fitted again into the cavities via the ends of the slat profiles, so that the entire slat profiles have to be removed again during dismantling.

SUMMARY

The present invention relates to a slat profile for holding an LED strip in a slat wall which can be attached to a supporting structure of the slat wall in order to be received in this slat wall as a slat, wherein said slat profile comprises a cavity in which the LED strip can be fitted, and comprises a slot along at least a part of its length which allows access to the cavity and which is covered by the LED strip once said LED strip has been fitted in the slat profile, wherein the slat profile comprises a supporting profile which can be attached to the supporting structure in order to attach the slat profile to the supporting structure, and comprises a closing profile which, in the installed position of the slat profile, is movable with respect to the supporting profile between an open position and a closed position, so that the LED strip can be fitted in the cavity in the open position.

The present invention also relates to a slat wall in which such a slat profile is accommodated as a slat.

It is an object of the present invention to provide a slat profile for holding an LED strip in which the LED strip can be replaced in a simpler manner (or can possibly be added later in a simple manner), without the entire slat profile having to be dismantled, and in which said slat profile can have a relatively large length, so that it is also possible to clad a façade section covering a relatively large surface using such slat profiles.

This object of the present invention is achieved by providing a slat profile for holding an LED strip in a slat wall which can be attached to a supporting structure of the slat wall in order to be received in said slat wall as a slat, wherein said slat profile comprises a cavity in which the LED strip can be fitted and, comprises a slot along at least a part of its length which allows access to the cavity and which is at least partly covered by the LED strip once said LED strip has been fitted, wherein the slat profile comprises a supporting profile which can be attached to the supporting structure in order to attach the slat profile to the supporting structure, and comprises a closing profile which, in the installed position of the slat profile, is movable with respect to the supporting profile between an open position and a closed position, so that, in the open position, the LED strip can be fitted in the cavity and, in the closed position, the supporting profile and the closing profile at least partly delimit said cavity and said slot, and in which the slot extends between the closing profile and the supporting profile, so that, in the installed position of the slat profile, the LED strip is clamped between the supporting profile and the closing profile.

By means of such closing profiles, the slat profile can be opened in the installed position in order to replace the LED strip without the entire slat profile having to be dismantled for this purpose. With the slat profiles as described in EP 2 177 705 A2 or in FR 2 076 213 A5, an LED strip would be attached to the supporting profile, with the closing profile only serving as a closure of the assembly. Due to the fact that, in a slat profile according to the invention, the LED strip, in the installed position, is clamped between the supporting profile and the closing profile, additional fastening elements are no longer required. The closing profile now also serves to clamp the LED strip in the fitted slat profile.

When such a slat profile is relatively long, it is possible, for example, for the supporting profile to be equally long, while the closing profile can be divided into several shorter closing profiles. In this way, a large slat is produced, in which the short closing profiles can easily be opened separately in order to replace an LED strip.

Preferably, a slat profile according to the invention also comprises a positioning element, by means of which the LED strip can be positioned in a fixed position in the cavity of the slat profile and in which the positioning element is arranged in such a manner that, in the installed position of the slat profile and in the installed position of the LED strip in the cavity of the slat profile, said LED strip is clamped between the supporting profile, the closing profile and the positioning element.

Such a positioning element may be designed in various ways and can, for example, be designed as a separate element which can optionally be attached to the supporting profile and/or can be attached to the closing profile. Alternatively, the positioning element can also be an integral part of the supporting profile or the closing profile. Thus, the positioning element may, for example, be co-extruded with the supporting profile. In a particular embodiment, the positioning element is of flexible design.

In a preferred embodiment of a slat profile according to the invention, the closing profile is pivotably displaceable with respect to the supporting profile.

Preferably, the closing profile can furthermore be attached to the supporting profile in a detachable manner. Thus, closing profiles and supporting profiles can be produced separately, for example, by extrusion of, for example, aluminium.

According to the present invention, a slat profile furthermore preferably comprises at least one intermediate piece which, in the installed position of the slat profile, is attached to the supporting profile on one side and is attached to the closing profile on the other side.

This intermediate piece may extend along the length of the slat profile or may be much shorter, in which case several of such shorter intermediate pieces are provided which are arranged on the supporting profile at a distance apart from each other.

Preferably, the closing profile is attached to the intermediate piece in a detachable manner and more specifically in a click-fitted manner to the intermediate piece in order to attach it to said intermediate piece in a detachable manner.

In this case, the intermediate piece may, more specifically, in the installed position of the slat profile, be attached to the supporting profile or may form an integral part of the supporting profile. Alternatively, the intermediate piece may be designed as a separate part of the slat profile.

Preferably, the intermediate piece is attached to the supporting profile in a detachable manner. To this end, the supporting profile may, in a particular embodiment of a slat profile, be provided with a groove with flanges, in which the intermediate piece can be slid into this groove, so that a part of the intermediate piece is anchored behind said flanges, in order to attach said intermediate piece in the groove to the supporting profile in a detachable manner.

The intermediate piece furthermore preferably divides the cavity into a ballast space directed away from said slot and an LED space adjacent to said slot, in which the LED strip can be introduced in the LED space in order to fit it in the cavity of the slat profile. Other components may then be arranged in the ballast space which may or may not be required for the LED lighting, such as for example inter alia control electronics, connecting clamps, earthing clamps, wiring, etc.

The intermediate piece of a specific embodiment of a slat profile comprises a cable cavity, into which a power cable for the LED strip can be introduced. Thus, such a power cable is given a fixed position in the cavity of the slat profile.

In a particular embodiment of a slat profile according to the present invention, said positioning element forms part of said intermediate piece.

Preferably, an intermediate piece of a slat profile according to the present invention is made completely of flexible plastic.

The object of the present invention is furthermore also reached by providing a slat wall comprising a slat profile according to the present invention as described above.

Such a slat wall according to the present invention preferably comprises a supporting structure on which the supporting profile can be attached in a detachable manner. In a specific embodiment, the supporting profile can then be click-fitted to the supporting structure so as to be detachable.

BRIEF DESCRIPTION OF THE DRAWINGS

The present invention will now be explained by means of the following detailed description of some preferred slat profiles and slat walls according to the present invention. This description is solely intended to give illustrative examples and to indicate further advantages and features of these slat profiles and slat walls and can therefore by no means be interpreted as a limitation of the area of application of the invention or of the patent rights defined in the claims.

In this detailed description, reference numerals are used to refer to the attached drawings, in which.

DETAILED DESCRIPTION OF THE DRAWINGS

Figure 1:
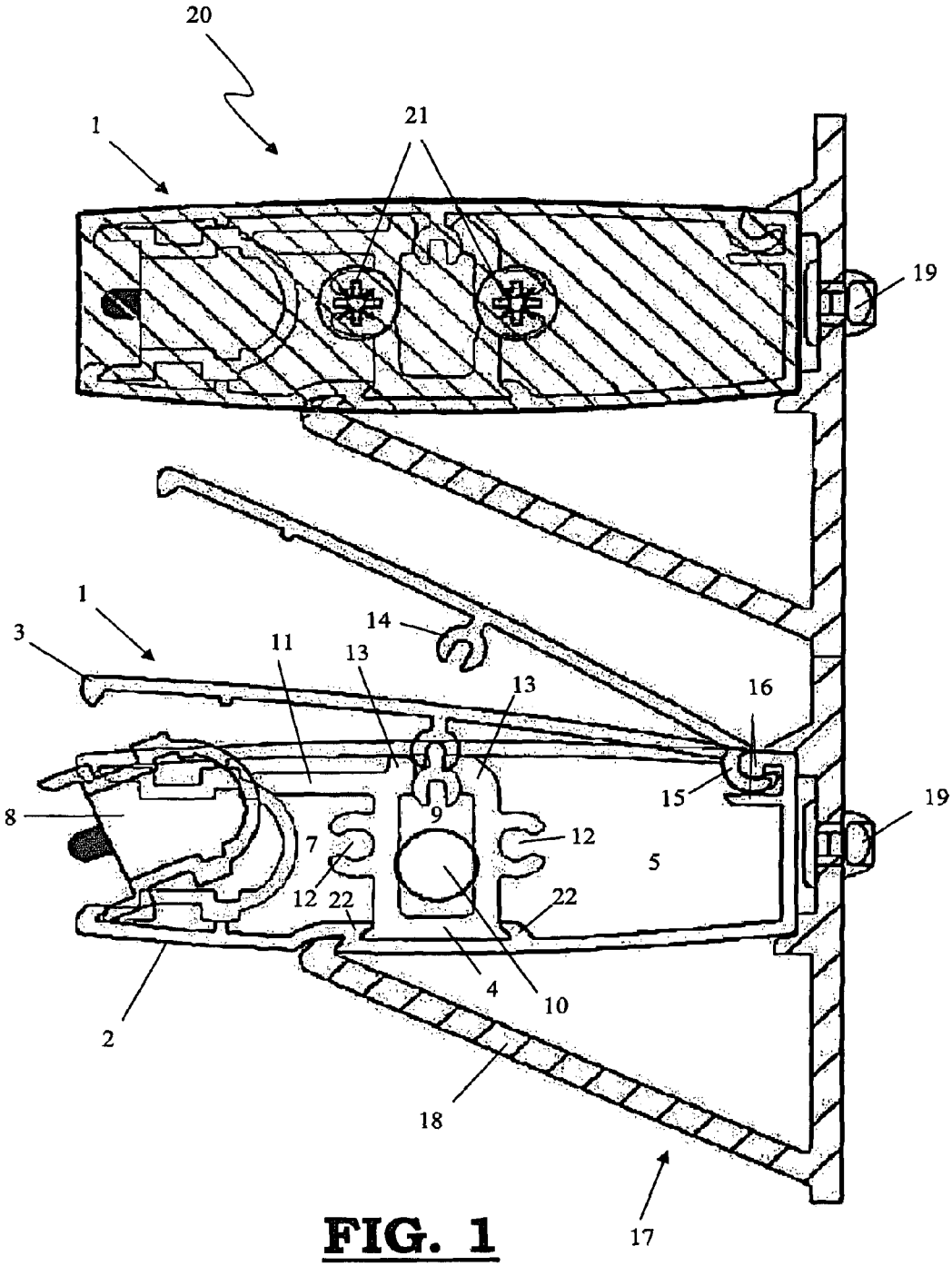
FIG. 1 shows a slat wall according to the present invention, comprising slat profiles according to the present invention, partly in side view and partly in cross section, with the closing profile of one of the slat profiles being shown in both the open position and in the closed position.
Figure 2:
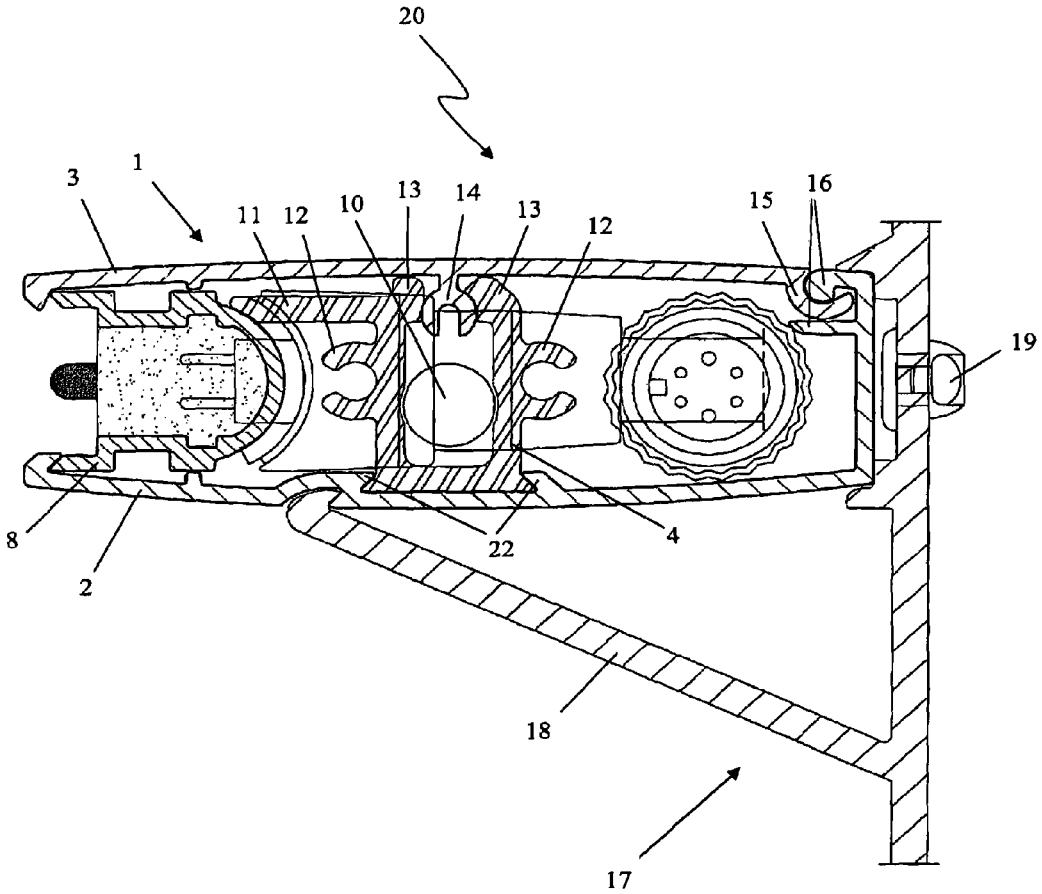
FIG. 2 shows a part of a slat wall according to the present invention at the location of a slat profile according to the present invention in cross section.

The slat walls (20) as illustrated comprise two or more slat profiles (1) which are fitted to a supporting structure (17) parallel to one another. At certain intermediate distances, the slat profiles (1) are in this case supported by supporting elements (18) of the supporting structure (17) in each case. Due to the fact that the slat profiles (1) in this case are supported at their bottom side by these supporting elements (18), the slat profiles (1) can be made longer than when these are attached between columns at their ends.

By means of fastening elements (19), the supporting structure (17) is attached to, for example, a façade. This supporting structure (17) may, for example, be made of aluminium.

The slat profiles (1) comprise a supporting profile (2) which can be click-fitted to the supporting structure (17) so as to be detachable. After the slat profiles (1) have been attached, these supporting profiles (2) are supported by the supporting elements (18) of the supporting structure at their bottom side. The slat profiles (1) furthermore comprise a closing profile (3) which, in the installed position of the slat profile (1), can be moved with respect to the supporting profile (2) between an open position and a closed position, as is illustrated with the bottom slat profile (1) from the slat wall (20) from FIG. 1. Both the supporting profile (2) and the closing profile (3) may, for example, be made from aluminium, by means of, for example, extrusion.

In alternative embodiments, the supporting profiles (2) could also be suspended from a supporting structure (17), in such a manner that these supporting profiles (2) form the top side of the slat profiles (1), with the closing profiles (3) closing off the bottom side of these slat profiles (1). Such embodiments are much easier to make watertight.

In the illustrated embodiments, the supporting profiles (2) form the bottom side of the slat profiles (1), while the closing profiles (3) form the top side of these slat profiles (1).

With the illustrated slat profiles (1), the closing profile (3) is in each case attached to the corresponding supporting profile (2) in a detachable manner. To this end, the closing profile (3) in the illustrated embodiment is provided with a hook element (15) which can be hooked between attachment elements (16) of the supporting profile (2), after which the closing profile (3) can be pivotably displaced with respect to the supporting profile (2) by pivotably displacing the hook element (15) between the attachment elements (16). This hook element (15) and these attachment elements (16) can be formed integrally along the length of the closing profile (3) and the supporting profile (2), respectively, by means of extrusion.

In the closed position of the closing profile (3), the closing profile (3) and the supporting profile (2) delimit a cavity which in this case extends along the length of the slat profile (1). At the front of the slat profile (1), there is, as is illustrated, a slot between the closing profile (3) and the supporting profile (2) which gives access to this cavity. Into the cavity, an LED strip (8) can be introduced in such a manner that this LED strip (8) then covers the slot at least partly and in such a manner that, when the LEDs of the LED strip (8) burn, their light is emitted via this slot. This LED strip (8) can be introduced into the cavity when the closing profile (3) is in the open position, as is illustrated for the bottom slat profile (1) in FIG. 1.

A slat profile (1) may comprise one or more such supporting profiles (2) and one or more such closing profiles (3). Preferably, such a slat profile (1) comprises one single supporting profile (2), in which, depending on the length of this supporting profile (2), one or more closing profiles (3) may be provided. The length of these closing profiles (3) is then preferably chosen in such a manner that they are easy to handle in order to be able to open the cavity located underneath and to replace an LED strip (8) or other components which may or may not be electronic situated in this cavity.

In addition to the supporting profile (2) and the closing profile (3), such a slat profile (1) also comprises one or more intermediate pieces (4). In the illustrated slat profiles (1), several intermediate pieces (4) having a length which is much shorter than the length of the supporting profile (2) are arranged on the supporting profile (2) at a distance apart from each other. To this end, the supporting profile (2) is provided with a groove having flanges (22), in which each intermediate piece (4) can be pushed into this groove, so that the bottom part of the intermediate piece (4) can be anchored behind these flanges (22) in order to secure this intermediate piece (4) in the groove.

Each intermediate piece (4) is provided with click-fit elements (13) between which a click-fit element (14) of the closing profile (3) can be click-fitted, so that the closing profile (3) can be attached to this intermediate piece (4) via a click-fit connection in a detachable manner. In order to be able to produce this click-fit connection quickly, the intermediate piece (4) is preferably made of a flexible plastic by means of, for example, injection-moulding.

The intermediate pieces (4) divide the cavity into a ballast space (5) directed away from said slot and an LED space (7) adjacent to said slot. The LED strip (8) can be introduced into the LED space (7) in order to fit it into the cavity of the slat profile (1). Each intermediate piece (4) is furthermore provided with a positioning element (11) which is arranged in such a manner that, in the installed position of the intermediate piece (4) and in the installed position of the LED strip (8) in the cavity of the slat profile (1), this LED strip (8) is clamped between the supporting profile (2) and the positioning element (11), as can clearly be seen in the figures. Other components can then be fitted in the ballast space (5) which may or may not be required for the LED lighting, such as for example inter alia control electronics, connecting clamps, earthing clamps, wiring, etc.

Each intermediate piece (4) is furthermore provided with a cable cavity (9), into which a power cable (10) for the LED strip (8) can be introduced. In the illustrated embodiments, this power cable (10) can be fitted in the cable cavity (9) between the click-fit elements (13) of each intermediate piece (4). In this way, this power cable (10) can be securely clamped in the slat profile (1) in a fixed position.

In order to protect the components which are fitted in the cavity against all kinds of ambient influences, end covers are provided on the ends of the slat profile (1) which can be attached to an intermediate piece (4) by means of screws (21). To this end, this intermediate piece (4) as illustrated is provided with screw passages (12).

The invention claimed is:

1. Slat profile for holding an LED strip in a slat wall wherein said slat profile can be attached to a supporting structure of the slat wall in order to be received in this slat wall as a slat, comprising:

a cavity in which the LED strip can be fitted, a slot along at least a part of its length which allows access to the cavity and which is covered by the LED strip once said LED strip has been fitted in the slat profile, a supporting profile which can be attached to the supporting structure in order to attach the slat profile to the supporting structure, a closing profile which, in the installed position of the slat profile on said supporting structure, is movable with respect to the supporting profile between an open position and a closed position, so that, in the open position, the LED strip can be fitted in the cavity, wherein, in the closed position, the supporting profile and the closing profile at least partly delimit said cavity and said slot, and the slot extends between the closing profile and the supporting profile, so that, in the installed position of the slat profile, the slat profile is suitable to clamp the LED strip between the supporting profile and the closing profile.

2. Slat profile according to claim 1, characterized in that the slat profile comprises a positioning element, by means of which the LED strip can be positioned in a fixed position in the cavity of the slat profile and in that the positioning element is arranged in such a manner that, in the installed position of the slat profile and in the installed position of the LED strip in the cavity of the slat profile, said LED strip is clamped between the supporting profile, the closing profile and the positioning element.

3. Slat profile according to claim 1, characterized in that the closing profile is pivotably displaceable with respect to the supporting profile.

4. Slat profile according to claim 1, characterized in that the closing profile can be attached to the supporting profile in a detachable manner.

5. Slat profile according to claim 1, characterized in that the slat profile comprises at least one intermediate piece which, in the installed position of the slat profile, is attached to the supporting profile on one side and is attached to the closing profile on the other side.

6. Slat profile according to claim 5, characterized in that the closing profile can be attached to the intermediate piece in a detachable manner.

7. Slat profile according to claim 5, characterized in that the intermediate piece, in the installed position of the slat profile, is attached to or forms an integral part of the supporting profile.

8. Slat profile according to claim 7, characterized in that the intermediate piece can be attached to the supporting profile in a detachable manner.

9. Slat profile according to claim 8, characterized in that the supporting profile is provided with a groove with flanges, in which the intermediate piece can be slid into this groove, so that a part of the intermediate piece is anchored behind said flanges, in order to attach said intermediate piece in the groove to the supporting profile in a detachable manner.

10. Slat profile according to claim 5, characterized in that the intermediate piece divides the cavity into a ballast space directed away from said slot and an LED space adjacent to said slot, in which the LED strip can be introduced in the LED space in order to fit it in the cavity of the slat profile.

11. Slat profile according to claim 5, characterized in that the intermediate piece comprises a cable cavity into which a power cable for the LED strip can be introduced.

12. Slat profile according to claim 5, characterized in that the positioning element forms part of the intermediate piece.

13. Slat wall comprising a slat profile according to claim 1.

14. Slat wall according to claim 13, characterized in that this slat wall comprises a supporting structure to which the supporting profile is attached in a detachable manner.

* * * * *